US008453794B2

(12) United States Patent
Melic

(10) Patent No.: US 8,453,794 B2
(45) Date of Patent: Jun. 4, 2013

(54) ANCHOR ASSEMBLY

(76) Inventor: Jonathan J. Melic, Stoney Creek (CA)

( * ) Notice: Subject to any disclaimer, the term of this patent is extended or adjusted under 35 U.S.C. 154(b) by 153 days.

(21) Appl. No.: 12/947,534

(22) Filed: Nov. 16, 2010

(65) Prior Publication Data

US 2012/0117913 A1 May 17, 2012

(51) Int. Cl.
*E04C 5/12* (2006.01)

(52) U.S. Cl.
USPC ..... 182/3; 182/82; 182/87; 182/230; 248/71; 248/72; 248/200; 52/698; 52/703

(58) Field of Classification Search
USPC ..... 182/3, 82, 87, 107, 230; 248/71, 248/72, 200, 231.21; 52/223.13, 223.14, 52/698, 703; 411/337; 104/115
See application file for complete search history.

(56) References Cited

U.S. PATENT DOCUMENTS

| | | | | | |
|---|---|---|---|---|---|
| 596,151 | A | * | 12/1897 | Funcke | 182/87 |
| 1,051,893 | A | * | 2/1913 | Joseph | 411/344 |
| 1,168,257 | A | * | 1/1916 | Kennedy | 411/346 |
| 1,431,799 | A | | 10/1922 | Hinckley | |
| 3,070,337 | A | * | 12/1962 | Gates | 182/87 |
| 3,269,679 | A | * | 8/1966 | Grappo | 248/72 |
| 3,555,747 | A | * | 1/1971 | Taylor | 52/40 |
| 4,330,230 | A | | 5/1982 | Giannuzzi | |
| D272,857 | S | * | 2/1984 | Leach | D25/68 |
| 4,519,477 | A | * | 5/1985 | Ralston | 182/107 |
| 4,932,185 | A | * | 6/1990 | Lebel | 52/704 |
| 5,011,106 | A | * | 4/1991 | Cody | 248/237 |
| 5,143,171 | A | * | 9/1992 | Glynn et al. | 182/3 |
| 5,226,768 | A | | 7/1993 | Speer | |
| 5,316,102 | A | * | 5/1994 | Bell | 182/3 |
| 5,687,535 | A | * | 11/1997 | Rohlf | 52/713 |
| 5,699,875 | A | * | 12/1997 | Dugan | 182/3 |
| 5,758,742 | A | * | 6/1998 | Chiou et al. | 182/3 |
| 5,813,486 | A | * | 9/1998 | Smith et al. | 182/3 |
| 5,850,889 | A | * | 12/1998 | Rexroad et al. | 182/3 |
| 6,298,629 | B1 | * | 10/2001 | Ador | 52/698 |
| 6,318,941 | B1 | * | 11/2001 | Guenther | 411/342 |
| 6,382,353 | B2 | * | 5/2002 | Laug | 182/107 |
| 6,595,477 | B2 | * | 7/2003 | Roberts | 248/219.3 |
| 6,672,427 | B1 | * | 1/2004 | Sheffield | 182/172 |
| 6,779,316 | B2 | * | 8/2004 | Carroll | 52/698 |
| 6,868,647 | B2 | * | 3/2005 | Poldmaa | 52/749.12 |
| D594,740 | S | | 6/2009 | Melic | |
| 7,992,679 | B2 | * | 8/2011 | Geens et al. | 182/3 |
| 2001/0025465 | A1 | | 10/2001 | Osfolk | |
| 2005/0016114 | A1 | | 1/2005 | Thompson | |
| 2007/0236023 | A1 | | 10/2007 | Beery | |
| 2010/0038172 | A1 | * | 2/2010 | Ralston | 182/107 |

OTHER PUBLICATIONS

Melic et al, Anchorage Connector Wedger Personal Fall Arrest System, 2009, Integrity Worldwide Inc., Ontario, CA.

* cited by examiner

*Primary Examiner* — Alvin Chin Shue
*Assistant Examiner* — Colleen M Chavchavadze
(74) *Attorney, Agent, or Firm* — Roger Emerson; Emerson Thomson Bennett

(57) ABSTRACT

An anchor assembly releasably securable to a structure with a receiving hole therethrough. The anchor assembly permits an object or person to be anchored to the structure and comprises a longitudinal member for placement through the receiving hole of the structure, first and second end portions, means to draw the first and second end portions into contact with the structure about the openings of the receiving hole with the longitudinal member positioned therethrough to secure the anchor assembly to the structure, and a visual indicator associated with at least one of the end portions. The end portions are larger in size than the openings of the receiving hole through the structure and the first and second end portions are received on opposite ends of said longitudinal member when the longitudinal member extends through the receiving hole. The visual indicator presents a visual signal identifying when the anchor assembly is secured to the structure.

8 Claims, 4 Drawing Sheets

ANCHOR ASSEMBLY

FIELD OF THE INVENTION

This invention relates to anchor assemblies, and more particularly to anchor assemblies that can be used to anchor an object to a structure having a receiving hole therethrough.

BACKGROUND OF THE INVENTION

In the construction industry, when workers are operating at heights that are more than a few feet off the ground it is often necessary for safety or legal purposes for the worker to secure himself rigidly to a structure through the use of a lanyard, belt or a fall arrest system. In some cases a secure structure to which a lanyard or similar device can be attached will be readily available to the worker. For example, in certain types of steel construction situations there are often structurally sound steel members (beams, girders, etc.) to which a worker can easily secure himself in order to prevent an accidental fall. However, there are many other construction situations where such structures are not readily available. For example, in high-rise apartment building, condominium and office tower construction, where walls and other structural members are primarily concrete, there are often no structural features present that offer a mechanism to which a worker can safely secure his lanyard or lifeline. As a result, others have proposed a variety of different anchors or similar devices that can be used for anchoring purposes.

One such type of anchor is characterized by a plunger having a flared distal end that is pulled to compress a coiled spring during installation. Upon release, the spring biases the plunger into engagement with the wall of a pre-drilled or existing hole within a concrete wall or column. The integrity of the anchor is limited to the mechanical and frictional engagement of the plunger with the interior surface of the walls of the hole. In most cases multiple holes must be drilled on a daily basis as workers move from location to location, and since the springs often cannot be relied upon to maintain an adequate anchoring if left overnight. The need to physically drill holes into concrete structures also increases the costs associated with installing the anchor and in some instances could potentially lead to a weakening of the concrete structure.

Others have proposed the use of safety straps that are attached to reinforcement bars disposed within the concrete with the ends of the straps extending out through the exterior surface of the wall or column. Such straps typically have D-rings sewn onto their terminal ends which a worker can use to attach a lanyard or lifeline. The difficulties associated with anchors of this type include not only their need to be inserted into the wall during the forming stage, but also their propensity to become worn or frayed through contact with the rough exterior of the concrete. Anchors of this type are sacrificial in nature and cannot be reused. If they become damaged or are no longer needed they are simply cut at the point that they extend through the concrete wall and then disposed of.

Still others have sought to utilize holes that extend through concrete walls and pillars that are left behind when the tie rods that hold the forms necessary to pour the walls are removed. Anchors have been developed to be received within these holes or passageways. Such anchors are generally of the expansion type that operate through the movement of an angular or wedge-shaped structure that causes an outward extension of the inner end of the anchor, driving it into frictional contact with the inside surface of the receiving hole.

While such devices have been somewhat successful, they too rely upon the frictional engagement of the interior end of the anchor with the interior surface of the hole through the concrete. As a result, inconsistencies in the diameter of the hole through the concrete and the possibility that the surface of the concrete may crumble under load, particularly if the concrete is still green and has not yet fully cured, present the potential for slippage of the anchor.

SUMMARY OF THE INVENTION

The invention therefore provides an anchor assembly that attempts to alleviate some of the problems associated with currently available anchors through the provision of an anchor assembly that can be easily and quickly installed, that provides a high level of security and that can be easily and readily removed and re-used time and time again.

Accordingly, in one of its aspects the invention provides an anchor assembly releasably securable to a structure, the structure having a receiving hole therethrough, the anchor assembly permitting an object or person to be anchored to the structure, the anchor assembly comprising a longitudinal member for placement through the receiving hole of the structure; first and second end portions, said end portions larger in size than the openings of the receiving hole through the structure, said first and second end portions received on opposite ends of said longitudinal member when said longitudinal member extends through the receiving hole; means to draw said first and second end portions into contact with the structure about the openings of the receiving hole with said longitudinal member positioned therethrough to thereby secure said anchor assembly to the structure; and, a visual indicator associated with at least one of said end portions, said visual indicator presenting a visual signal identifying when said anchor assembly is secured to the structure.

In a further aspect the invention provides an anchor assembly releasably securable to a structure, the structure having a receiving hole therethrough, the anchor assembly permitting an object or a person to be anchored to the structure, the anchor assembly comprising a longitudinal member for placement through the receiving hole of the structure; first and second end portions, said first and second end portions including generally conical centering sleeves, said first and second end portions received on opposite ends of said longitudinal member when said longitudinal member is placed in the receiving hole of the structure and extends therethrough; and means to draw said conical centering sleeves into contact with said structure about the openings of said receiving hole to secure the anchor assembly to the structure, said conical shaped centering sleeves facilitating the centralization of said longitudinal member within the receiving hole and permitting said anchor assembly to be utilized in association with receiving holes having varying internal dimensions.

The invention also concerns an anchor assembly releasably securable to structure, the structure having a receiving hole therethrough, the anchor assembly permitting an object or person to be anchored to the structure, the anchor assembly comprising a longitudinal member for insertion through the receiving hole of the structure, said longitudinal member including a hollow sleeve portion and a threaded portion threadably received within at least one end of the hollow sleeve portion such that relative rotation between the threaded portion and the hollow sleeve portion permits an adjustment of the length of the longitudinal member; a first end portion received on an outer end of said hollow sleeve portion of said longitudinal member and a second end portion received on an outer end of said threaded portion of said longitudinal member, said first and second end portions on opposite sides of the structure when said longitudinal member extends through the receiving hole, said first and second end portions larger in size than the openings of the receiving hole and secured to the respective ends of said longitudinal member such that relative rotation between said threaded portion and said hollow sleeve portion of said longitudinal member in one direction results in a shortening of said longitudinal member with said first and second end portions being forced into contact with the outer surfaces of the structure; and at least one visual indicator associated with at least one of said end portions, said visual indicator presenting a visual signal to identify to an operator when said end portions are in contact with the structure and said anchor assembly is secured thereto.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
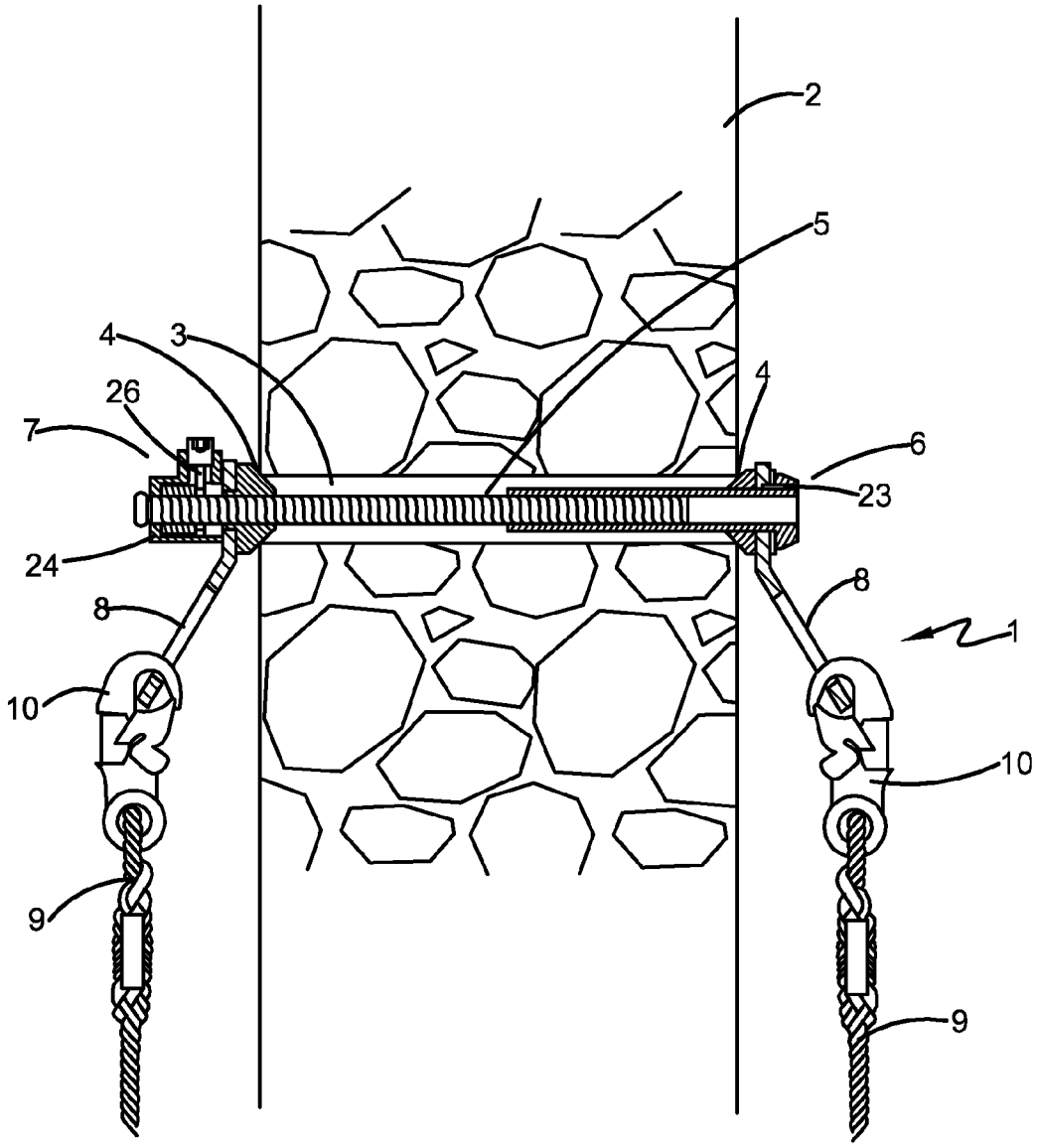
FIG. 1 is a side sectional view through a concrete wall showing the deployment of an anchor assembly in accordance with one of the preferred embodiments of the present invention, the anchor assembly shown in partial longitudinal section.

With reference to the attached Figures, one of the preferred embodiments of the anchor assembly constructed in accordance with the present invention is noted generally by reference numeral 1. In FIG. 1, anchor assembly 1 is shown as it would typically be releasably secured to a structure 2, which in this instance is a concrete wall or pillar. Structure 2 has a receiving hole 3 extending through it with openings 4 on its opposed exterior surfaces. From a thorough understanding of the invention, it will be understood that where structure 2 is a concrete wall or pillar, receiving hole 3 will be in many instances the hole that is left extending through the concrete after tie rods, that hold forms in place while the concrete is poured, have been removed. In other instances it may be necessary, or desirable, to drill a hole through the concrete to act as a receiving hole for anchor assembly 1. It will also be appreciated that in circumstances where structure 2 is other than a concrete wall or pillar, a receiving hole could be a pre-existing hole formed in the structure or could also be drilled or otherwise formed.

In general, anchor assembly 1 comprises a longitudinal member 5 and first and second end portions 6 and 7, respectively. The longitudinal member is configured and sized for placement through the receiving hole and in one embodiment is adjustable in length to enable it to accommodate receiving holes of different depths and also, as will be discussed in more detail below, to provide one mechanism by which the anchor assembly can be securely fastened to structure 2. First and second end portions are larger in size than openings 4 of receiving hole 3 and are received on opposite ends of longitudinal member 5 when the longitudinal member extends through the receiving hole.

At least one of first end portion 6 and second end portion 7 includes a D-ring, clevis or an anchorage connector to which a cable, chain, strap, rod, rope, lanyard or any other such device or method may be attached in order to permit an object or a person to be secured or anchored to structure 2. In the attached drawings, the first and second end portions are shown as including a D-ring anchorage connector 8 to which a lanyard 9 may be secured using a standard snap hook 10. The D-ring is preferably rotationally received on the anchor assembly to accommodate an angular (non-vertical) loading by the lanyard.

Although not shown, the opposite end of lanyard 9 would typically be connected to a safety belt or harness worn by a worker such that should a worker lose his footing and fall, the attachment of lanyard 9 to D-ring 8 will limit the distance that the worker can fall and help prevent serious injury or death. It will be appreciated by those skilled in the art that the particular configuration of D-ring or anchorage connector 8 could vary while remaining within the broad scope of the invention. To facilitate the attachment of snap hook 10 to the D-ring, in the embodiment shown the D-ring is formed such that its opening is at an acute angle relative to the outer face of structure 2. It will also be appreciate that while in most applications it is expected that the anchor assembly 1 and D-ring 8 will be used to secure or anchor an individual to structure 2, in some instances it may be desirable to use the anchor assembly to tie-off or secure a particular object.

In a preferred embodiment of the invention each of the first and second end portions includes a centering sleeve 11. The centering sleeves are preferably generally conical in shape with their vertices or apexes directed inwardly toward structure 2. Anchor assembly 1 further includes means to draw the first and second end portions into contact with structure 2 about openings 4 in receiving hole 3 when longitudinal member 5 is positioned through the receiving hole. Centering sleeves 11 are preferably of a size and configuration such that when the first and second end portions are drawn into contact with the exterior of structure 2 about openings 4, at least a portion of centering sleeves 11 will be received within receiving hole 3 to help facilitate the centralization of the longitudinal member within the receiving hole. The engagement of centering sleeves 11 with openings 4 further permits anchor assembly 1 to be utilized with receiving holes of varying internal dimensions and shapes. This aspect of the centering sleeves can be particularly advantageous in situations where removal of the tie rods results in a sloughing of concrete about openings 4 causing the outer-most portion of the hole to be of a dimension or diameter larger than the interior portion of the hole. With first and second end portions 6 and 7 drawn into contact with the surface of structure 2, and secured in place, the anchor assembly will be anchored to structure 2 permitting lanyard 9 to be then safely attached to D-ring 8.

In the embodiment of the invention shown in the attached drawings, longitudinal member 5 is comprised of a threaded portion 12 and a hollow sleeve portion 13. The threaded portion 12 has an inner end 14 and an outer end 15. Similarly, hollow sleeve portion 13 has an inner end 16 and an outer end 17. At least a portion of the inner end 14 of the threaded portion 12 is threadably received within the inner end 16 of hollow sleeve portion 13 such that relative rotation between the threaded portion and the hollow sleeve portion permits an adjustment of the length of the longitudinal member. To a certain degree, adjustment of the length of the longitudinal member in this manner will facilitate the use of anchor assembly 1 on structures having receiving holes of different depths without having portions of the length of the longitudinal member extending an unacceptable distance outwardly from the surface of structure 2. That is, in some instances an excessively long longitudinal member may result in a portion of the longitudinal member extending outwardly beyond the surface of structure 2 to the point that it may present a hazard to workers walking by or working in the vicinity of the anchor assembly.

Figures 3, 3A, 3B:
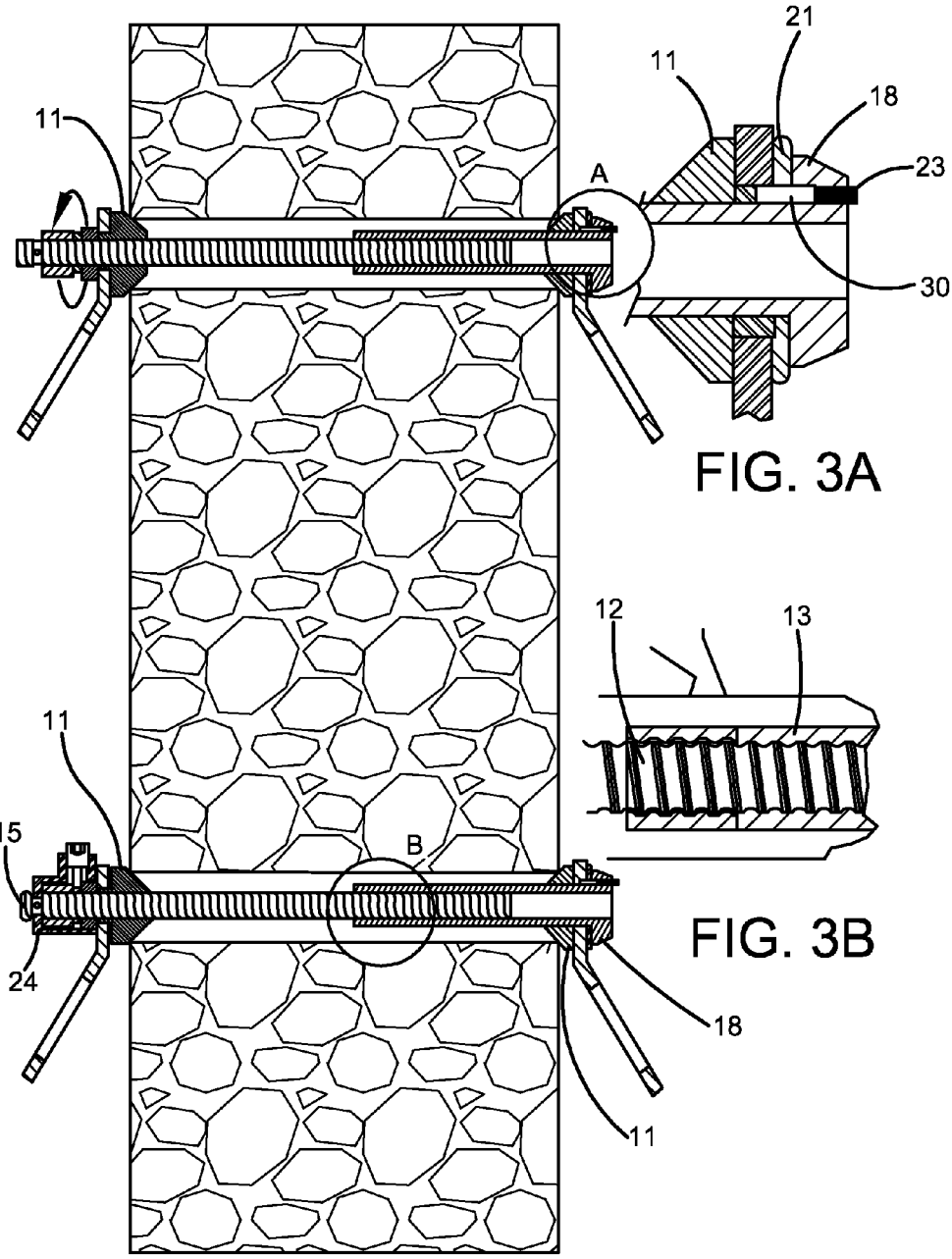
FIG. 3 is a sectional view similar to FIGS. 1 and 2 depicting the deployment of the anchor assembly within a receiving hole in the concrete wall.
FIG. 3A is an enlarged detailed view of portion A in FIG. 3.
FIG. 3B is an enlarged detailed view of portion B in FIG. 3.
Figure 4:
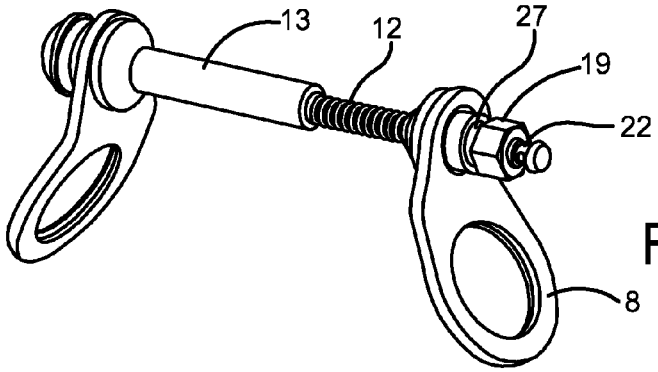
FIG. 4 is a side perspective view of the anchor assembly of FIG. 1.
Figure 5:
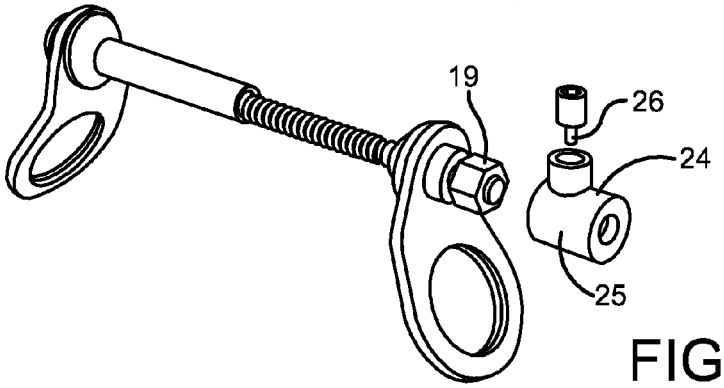
FIG. 5 is a side perspective view similar to FIG. 4 including, in exploded form, a lock to prevent the unauthorized disengagement of the anchor assembly.
Figure 6:
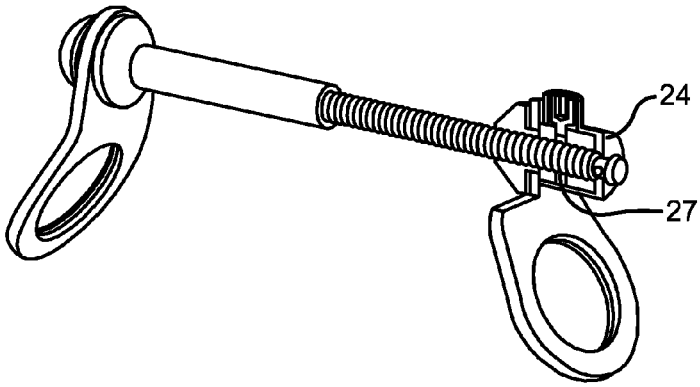
FIG. 6 is a side perspective view similar to FIG. 5 wherein the lock has been secured to the anchor assembly, the lock and the related end of the anchor assembly shown in vertical section; and, FIG. 7 is a side perspective view opposite to that of FIG. 6 wherein the first end portion of the anchor assembly is shown in vertical section.
Figure 7:
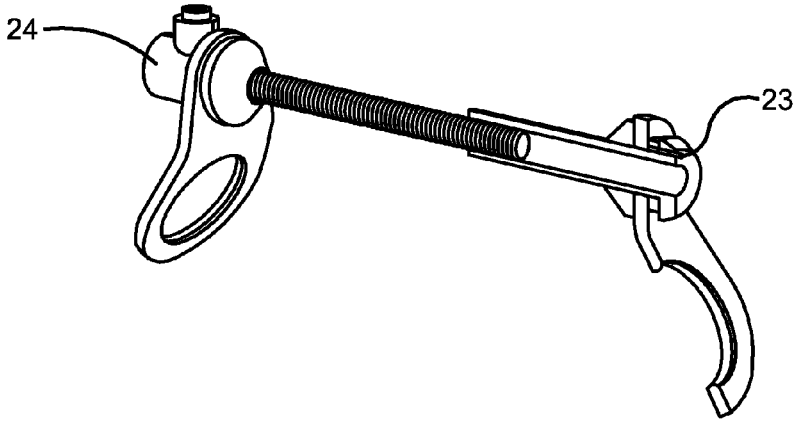

With reference to the embodiment shown in FIG. 3, the first end portion 6 of the anchor assembly is received on the outer end of the hollow sleeve portion and includes a head 18 that is rigidly secured to the hollow sleeve portion. Interior to the head 18 (see FIGS. 3 and 3A) is situated one of the centering sleeves 11 such that drawing the hollow sleeve portion into the receiving hole causes head 18 to draw the centering sleeve into contact with the surface of structure 2 about opening 4. In this manner attaching the anchor assembly to structure 1 can be accomplished through accessing only one side of the structure after longitudinal member 5 has been inserted through the receiving hole. In the example shown, rigidly securing the anchor assembly to structure 2 thus requires access only to the left hand side of the structure (FIG. 3).

Figures 2, 2A:
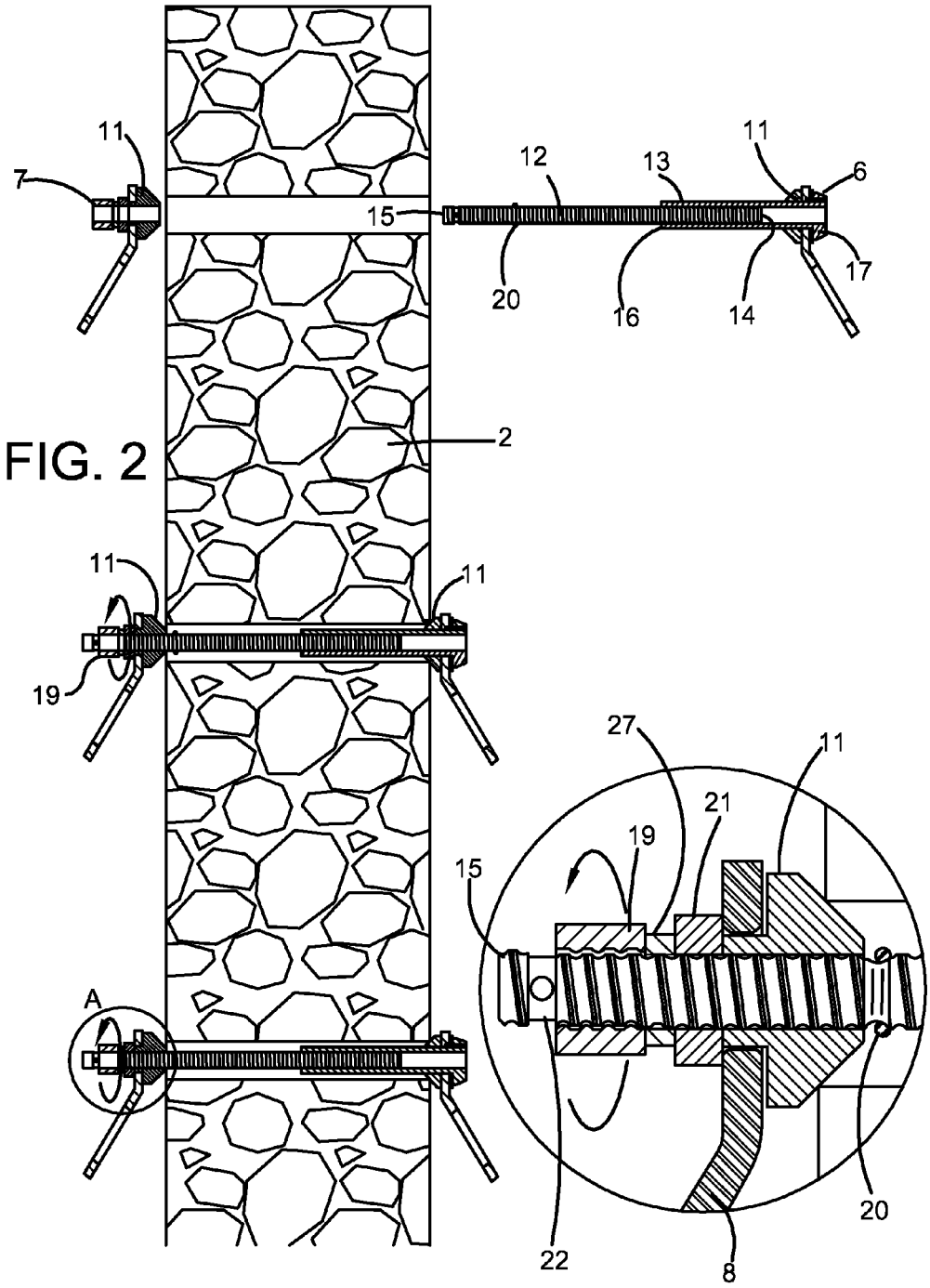
FIG. 2 is a side sectional view similar to FIG. 1 showing the progressive deployment of the anchor assembly and its securement to the concrete wall.
FIG. 2A is an enlarged detailed view of the portion A in of FIG. 2.

It will be appreciated that drawing the first and second end portions into contact with structure 2 can be accomplished in a variety of different manners. With reference to FIG. 2, the particular manner in which the depicted embodiment of the anchor assembly is secured to structure 2 will be now described.

The upper portion of FIG. 2 shows longitudinal member 5 about to be inserted into receiving hole 3. The longitudinal member has a centering sleeve 11 and a D-ring 8 positioned on the outer end of hollow sleeve portion 13. Head 18 of the hollow sleeve portion limits the movement of the centering sleeve and D-ring in an outward direction. Second end portion 7 of the anchor assembly is shown positioned on the opposite side of structure 2.

In the middle portion of FIG. 2 the longitudinal member is shown as now having been fully inserted through receiving hole 3 with second end portion 7 received about the outer end 15 of the threaded portion 12 of the longitudinal member. In this instance the second end portion has a central bore extending through it which receives the outer end of the threaded portion of the longitudinal member. Second end portion 7 includes a threaded nut 19 that permits the second end portion to be fastened to the longitudinal member. When second end portion 7 is initially threaded upon the outer end of longitudinal member 5, nut 19 is rotated about the longitudinal member to force the second end portion inwardly towards structure 2. As shown in FIGS. 2 and 2A, a stop 20 (which may comprise a weld, clip or other similar structure) is preferably positioned on the exterior surface of threaded portion 12 in order to limit the inward movement of the second end portion along the length of the threaded portion as nut 19 is rotated. Nut 19 can thus be used to securely fasten the second end portion to the longitudinal member while preventing an excessive amount of the threaded portion of the longitudinal member from extending outwardly from the surface of structure 2. Provided that the "slack" in the length of longitudinal member 5 has been taken up by adjusting the amount that the threaded portion 11 is threadably received within hollow sleeve portion 13 prior to installing and tightening nut 19, the later tightening of nut 19 will have the effect of drawing both of the centering sleeves into contact with their related sides of structure 2, generally centering the longitudinal member within the receiving hole and securing the anchor assembly to the structure.

Further rotation of threaded nut 19 once the centering sleeve 11 of second end portion 2 has come into contract or bottomed-out against stop 20 will cause the threaded portion 12 of the longitudinal member to be threaded further into hollow sleeve portion 13 and thereby further tighten the anchor assembly within the receiving hole. As also shown in FIG. 2, second end portion 7 may contain a D-ring 8 and a spacer 21. With reference to FIGS. 3 and 3A, first end portion 6 may also include a spacer 21. Spacer 21 preferably is, or includes, an elastomeric or spring element that serves to help absorb vibration and stress that may be applied through lanyard 9 to D-ring 8.

In a preferred embodiment of the invention anchor assembly 1 further includes a visual indicator associated with at least one of end portions 6 and 7. The visual indicator (or indicators) presents a visual signal to an operator to indicate when the anchor assembly has been secured to structure 2. Drawing the first and second end portions into contact with structure 2 such that the centering sleeves contact the structure about the openings of the receiving hole activates the visual indicator (or indicators) signalling that the anchor assembly is safely secured to the structure. While a visual indicator may be used in associate with either first end portion 6 or second end portion 7, preferably each end portion has its own visual indicator so that workers operating on either side of structure 2 can quickly and easily glance at the anchor assembly, look for the presence of the visual indicator and instantly know whether the anchor assembly is secure or unsecure.

The particular form of the visual indicator may vary while remaining within the broad scope of the invention. In the embodiment shown, the visual indicator on second end portion 7 is in the form of a painted stripe located near the outer-most aspect of outer end 15 of threaded portion 12 of the longitudinal member. When threaded nut 19 is tightened and threadedly received upon the outer end of the threaded portion to the point that it causes centering sleeve 11 to contact or bottom out against stop 20, the painted part of the threaded portion 12 which comprises visual indicator 22 on second end portion 7 will become visible, thereby signalling to a worker that the threaded nut 7 is tight and that the anchor assembly is secured to structure 1.

As mentioned, the structure of the anchor assembly shown permits the device to be secured in place through accessing and tightening a nut on only one side of the structure. As a result, in this embodiment there is no nut to be tightened on first end portion 6 that can reveal a visual indicator. For that reason, first end portion 6 is fitted with an indicator pin 23 that is normally received within head 18 when the anchor is in its unsecured configuration. As the centering sleeve 11 of first end portion 6 is drawn into contact with structure 2, a bushing 30, that bears against the interior end of pin 23 and the surface of D-ring 8, transfers longitudinal movement from the centering sleeve, to the D-ring, through the bushing and ultimately to indicator pin 23. Pin 23 is then driven outwardly through the exterior surface of head 18 to provide a visual indication that the anchor assembly is secure and safe to use. Since spacer 21 is or includes an elastomeric or spring element, it will be appreciated that when the anchor is in its unsecured configuration spacer 21 will cause centering sleeve 11 of first end portion 6 to be driven away from head 18, thereby retracting pin 23 into the head and signalling to an operator that the anchor is not safe.

Once the anchor assembly is fully secured to structure 2, it may be desirable to utilize a lock to prevent the unauthorized disengagement of the first and second end portions from the structure. Since in the embodiment shown the anchor assembly is secured to the structure by accessing and rotating second end portion 7, a single lock 24 may be utilized. Lock 24 may be comprised of a shield or shroud 25 that is placed over the end of second end portion 7, and particularly over threaded nut 19, to prevent access thereto. Lock 24 may include a pin 26 that is received within a circumferential recess 27 about the second end portion to prevent the lock from being removed longitudinally off member 5. It is important to note that in this embodiment lock 24 is configured with a hole in its outer-most end to allow the outer end 15 of threaded portion 12 to extend through the lock. In this manner an operator will still have visual access to visual indicator 22 on second end portion 7 when the lock is in place.

It will thus be appreciated that the described structure, and that as shown in the attached drawings, provides an anchor assembly that can be safely, securely and quickly attached to a structure, such as a concrete wall or column. The anchor assembly can accommodate receiving holes through the structure of varying lengths and internal dimensions and configurations, and permits an operator to install the anchor without the need for tightening bolts or nuts on both sides of the structure. There is further provided a visual indicator on each side of the assembly that quickly and instantly identifies to a worker whether or not the anchor assembly has been fully engaged and whether or not it is safely secured to the structure. A lock mechanism can be installed to prevent unauthorized access or removal of the anchor assembly. The lock does not interfere with the operation of the visual indicator that provides workers with confidence that they can attach their lanyards to the anchor assembly without fear of the anchor giving way. The device further permits workers to safely secure themselves to opposite sides of a partition or structure using a single anchor. Two workers may also simultaneously secure themselves to opposites sides of a structure using a single anchor.

It is to be understood that what has been described are the preferred embodiments of the invention and that it may be possible to make variations to these embodiments while staying within the broad scope of the invention. For example, while reference has been made to a concrete structure, structure 2 could also be formed from steel, wood, brick or other materials. Further, in an alternate embodiment longitudinal member 5 could be of unitary construction rather than being formed from separate threaded and sleeve portions. Other variations have been discussed, while still others will be readily apparent to those skilled in the art.

I claim:

1. An anchor assembly releasably securable to a structure, the structure having a receiving hole therethrough, the anchor assembly permitting an object or person to be anchored to the structure, the anchor assembly comprising:

a longitudinal member for insertion through the receiving hole of the structure, said longitudinal member including a hollow sleeve portion and a threaded portion threadably received within at least one end of the hollow sleeve portion such that relative rotation between the threaded portion and the hollow sleeve portion permits an adjustment of the length of the longitudinal member;

a first end portion received on an outer end of said hollow sleeve portion of said longitudinal member and a second end portion received on an outer end of said threaded portion of said longitudinal member, said first and second end portions on opposite sides of the structure when said longitudinal member extends through the receiving hole, said first and second end portions larger in size than the openings of the receiving hole and secured to the respective ends of said longitudinal member such that relative rotation between said threaded portion and said hollow sleeve portion of said longitudinal member in one direction results in a shortening of said longitudinal member with said first and second end portions being forced into contact with the outer surfaces of the structure; and at least one visual indicator associated with at least one of said end portions, said visual indicator presenting a visual signal to identify to an operator when said end portions are in contact with the structure and said anchor assembly is secured thereto.

2. The anchor assembly as claimed in claim 1 wherein each of said first and second end portions have a visual indicator associated therewith.

3. The anchor assembly as claimed in claim 1 wherein each of said first and second end portions includes a generally conical shaped centering sleeve, said centering sleeves directed toward said structure and facilitating the centralization of said longitudinal member within the receiving hole when said first and second end portions are forced into contact with the surfaces of the structure.

4. The anchor assembly as claimed in claim 1 wherein said conical shaped centering sleeves permit said end portion to accommodate receiving holes of varying internal dimension.

5. The anchor assembly as claimed in claim 1 wherein at least of one said first and second end portions includes a D-ring, clevis or anchorage connector to which a cable, chain, strap, rope, rod or lanyard may be attached.

6. The anchor assembly as claimed in claim 5 wherein said D-ring, clevis or anchorage connector includes an elastomeric spacer at its point of contact with its associated end portion, said elastomeric spacer helping to absorb vibration and stress applied to said end portion by said D-ring, clevis or anchorage connector.

7. The anchor assembly as claimed in claim 3 wherein said first end portion includes a head rigidly secured to said hollow sleeve portion such that adjustment of the length of the longitudinal member causes said centering sleeve on said first end portion to contact the surface of the structure about the opening of the receiving hole.

8. The anchor assembly as claimed in claim 1 including a lock to prevent the unauthorized disengagement of said first and second end portions with the structure.

* * * * *